United States Patent [19]

Anderson

[11] Patent Number: 4,790,717

[45] Date of Patent: Dec. 13, 1988

[54] IMPLEMENT FOR MOVING ROCKS AND THE LIKE

[75] Inventor: Ronald L. Anderson, Burlington, Iowa

[73] Assignee: J. I. Case Company, Racine, Wis.

[21] Appl. No.: 132,773

[22] Filed: Dec. 14, 1987

[51] Int. Cl.[4] ..... B67C 1/00

[52] U.S. Cl. ..... 414/722; 414/785

[58] Field of Search ..... 414/722, 723, 785; 37/2 R; 171/63; 172/254

[56] References Cited

U.S. PATENT DOCUMENTS

| | | | |
|---|---|---|---|
| 3,643,821 | 2/1972 | Viel | 414/722 X |
| 3,887,015 | 6/1975 | Kelley | 172/254 |
| 4,256,337 | 3/1981 | Wappler | 414/722 X |
| 4,537,549 | 8/1985 | Knels | 414/722 X |

*Primary Examiner*—Leslie J. Paperner
*Assistant Examiner*—Donald W. Underwood
*Attorney, Agent, or Firm*—Peter N., Ltd. Jansson

[57] ABSTRACT

An improved boom-supportable device for lifting large rocks, broken concrete or asphalt pieces, and the like from the ground without particulates. The invention includes a generally upright frame member having a lower edge, a shelf-like member extending laterally from the frame lower edge to a distal end and defining substantial voids, and devices removably attaching the shelf-like member to the frame lower edge selectively in either a forward position or a rearward position. The shelf-like member preferably has a plurality of elongated parallel teeth spaced along the lower edge. The teeth are most preferably separate, each individually attached to the lower edge.

19 Claims, 2 Drawing Sheets

IMPLEMENT FOR MOVING ROCKS AND THE LIKE

FIELD OF THE INVENTION

This invention is related generally to lifting and moving equipment and, more particularly, to devices for lifting and moving large rocks, broken concrete and asphalt pieces and the like.

BACKGROUND OF THE INVENTION

Many different devices, particularly boom-supportable devices, have been developed over the years for lifting and moving materials such as dirt, rocks, broken materials and the like. Such equipment is used in many different operations. Vehicles of various kinds frequently suspend such lifting and moving devices on the distal ends of booms which are used to manipulate the devices in various ways to lift, remove, and later release the materials which they carry.

For various reasons, it is often desirable to lift and move large rocks, broken pieces of concrete, broken pieces of asphalt, or the like without carrying with them dirt, sand, gravel, and other particulates. Such "clean" lifting and movement is useful, for example, in removing broken concrete or asphalt pieces of the type frequently created by the breaking up of roadbeds, sidewalks, and the like, when recycling of the removed material is anticipated. Such removal, without undesired particulates, allows later recycling to be carried out with a minimum of impurities. There are many other reasons for wanting to "cleanly" remove large rocks, broken concrete, broken asphalt, and the like.

The equipment of the prior art frequently does not perform such removal operations adequately or has disadvantages making its use undesirable or impractical. This is often the case for the small contractor who does not wish to acquire expensive equipment for the task.

In some cases, space limitations and other operational constraints can limit the maneuverability of lifting and moving equipment. This makes "clean" lifting and moving of large pieces from the ground to another location more troublesome than it would otherwise be. For example, in removing large pieces of broken asphalt or broken concrete from a driveway, or pieces of broken concrete from a sidewalk, a boom-supported lifting device sometimes cannot easily pick up and deposit such pieces cleanly because the movement of the boom and the position of the vehicle from which the boom extends are limited by the surroundings. Adjustment of scoop-like digging devices to accommodate such limitations and constraints is frequently time-consuming or impossible.

In some cases, devices which would otherwise provide a grid allowing "clean" lifting and movement of large pieces is susceptible to bending and distortion of certain parts by virtue of the heavy forces exerted on the devices by large and irregularly shaped stones, concrete or asphalt pieces, and the like. Such bending and distortion tend to make such equipment less useful or non-functional. Replacement of such equipment may be expensive and time-consuming.

In short, there is a need for improved equipment for "clean" lifting and moving large pieces, such as rocks, broken concrete and broken asphalt.

OBJECTS OF THE INVENTION

It is an object of this invention to provide an improved device for lifting and moving large rocks and the like which overcomes some problems and shortcomings of the prior art, including those mentioned above.

Another object of this invention is to provide an improved device for lifting and moving large rocks, broken concrete, broken asphalt and the like without also carrying substantial amounts of particulates.

Another object of this invention is to provide an improved boom-supportable device for "clean" lifting and moving of large rocks and the like which is readily adaptable to certain common space and operational constraints.

Another object of this invention is to provide an improved boom-supportable lifting and moving device which may be selectively configured for operation in two different ways, without demounting of the device from the boom.

Another object of this invention is to provide an improved lifting and moving device of the type described above which may be reoriented by easy manual lifting and reorientation of its parts.

Another object of this invention is to provide an improved device for lifting and moving large pieces of broken recyclable materials from roadways and the like without unwanted particulates.

Another object of this invention is to provide an improved device of the type described which may be readily repaired by simple replacement of only the damaged portions.

These and other important objects will be apparent from the descriptions of this invention which follow.

SUMMARY OF THE INVENTION

This invention is an improved boom-supportable device for lifting large rocks, broken concrete, broken asphalt, and the like, which overcomes certain problems and shortcomings of the prior art, including those mentioned above.

The device is mounted on a boom, such as a backhoe boom, and includes means for connection to a boom similar to the connection means of a backhoe bucket. A frame member is secured to the connection means and extends downwardly from it to a lower edge. Means forming a shelf extends laterally from a proximal end along the lower edge to a distal end. Such shelf means defines substantial voids across it allowing the shelf means to support large rocks, broken concrete or asphalt pieces, and the like without holding particulates.

Apparatus along the lower edge of the frame member removably attaches the proximal end of the shelf means to the lower edge of the frame member. The frame member, shelf means, and attachment means are configured and arranged such that attachment may be in either of two positions—one extending forwardly and the other extending rearwardly. Thus, without any need for disconnecting the frame member from the backhoe boom or other boom, the boom-supportable device may be changed readily from a forwardly-extending scoop-like member to a rearwardly-extending scoop-like member.

The shelf means is preferably formed of a plurality of elongated parallel teeth spaced along the lower edge. Most preferably, the teeth are separate from one another, each one being individually attached to the lower edge.

Such elongated teeth are preferably flat teeth mounted edgewise on the lower edge of the frame member. This mounting orientation gives better support for heavy rocks, concrete pieces, asphalt pieces, and the like, and also serves to facilitate removable and reversible attachment of the teeth to the lower edge of the frame member.

In certain highly preferred embodiments, each flat tooth has at least one hole, and preferably a pair of holes, in it along the proximal end. In such cases, the attachment means preferably includes at least one rod, and most preferably a pair of rods, extending through the frame member and through the hole(s) in the flat teeth.

The plurality of teeth preferably includes two end teeth, each end tooth having a side member extending upwardly from it. This serves to prevent rocks and the like from falling from the shelf means during lifting operations.

The frame member itself is a generally upright member which preferably includes spaced upper and lower members and a plurality of spaced vertical members extending between the upper and lower members. Substantial voids are defined between the vertical members to allow support for large rocks and the like without holding particulates.

The orientation of the device of this invention changes as the backhoe boom or other boom is manipulated by the operator. Usually the shelf means is generally horizontal with the frame member generally vertical, but the device often may be in an orientation in which the frame member and shelf means form a V with its point straight down, and the frame member may often be a bit closer to horizontal than vertical. Regardless of the orientation of the preferred embodiments, particulates such as dirt, sand, small pebbles and the like will fall through voids either in the shelf means or in the frame member, allowing more or less clean lifting and transfer of large rocks, broken concrete and asphalt, and the like.

The frame member preferably has a flat horizontal lower member forming its lower edge. Preferred embodiments have a plurality of elongated parallel teeth, as described above, spaced along such flat horizontal lower member. Such flat teeth are preferably mounted edgewise on the lower member to allow more structural strength as already explained.

In such preferred embodiments, the frame member preferably includes flat vertical members each affixed to the flat horizontal lower member and extending upwardly from it immediately adjacent to a flat tooth. Such vertical members are attached to the teeth immediately adjacent to them. A pair of such flat vertical members are most preferably included, each pair receiving a flat tooth therebetween. One of such flat vertical members of each pair preferably extends all the way to an upper frame member as one of the vertical member previously described.

In such embodiments, it is highly preferred that each flat tooth have at least one hole, and preferably a pair of holes, in it along the proximal end and that each flat vertical member attached to a tooth have at least one hole and preferably a pair of holes in it, each adjacent to one of the tooth holes. Thus, the attachment rods mentioned above will extend through the frame member and through the holes in the flat teeth and flat vertical members.

As referred to above, a boom is typically supported by a vehicle, the boom having a proximal end secured to the vehicle and a distal end movable with respect to the vehicle to which the scoop-like member described above is connected. It has been found that backhoes may readily be equipped with such scoop-like member and that the easy selective orientation of the device, without demounting from the backhoe, makes it particularly useful for a variety of tasks, including removal of broken concrete or asphalt from roads, driveways, sidewalks and the like.

The teeth, particularly when separate teeth are used as in many of the preferred embodiments described above, are light in weight. This makes reorientation a very quick and easy task. Furthermore, replacement of a tooth after bending is very easily accomplished.

The invention is particularly helpful in the task of recovering broken concrete or asphalt pieces without dirt and extraneous particulates, for recycling purposes.

DETAILED DESCRIPTIONS OF PREFERRED EMBODIMENTS

Figure 1:
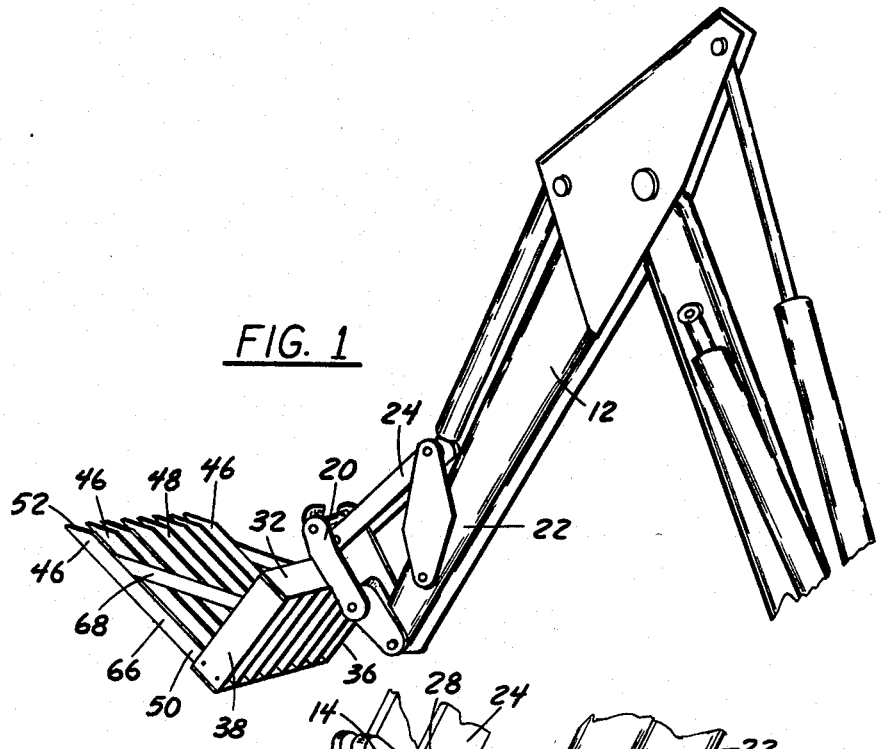
FIG. 1 is a perspective view of the lifting device of this invention, secured to a backhoe boom and having its teeth oriented in a forward direction.
Figure 2:
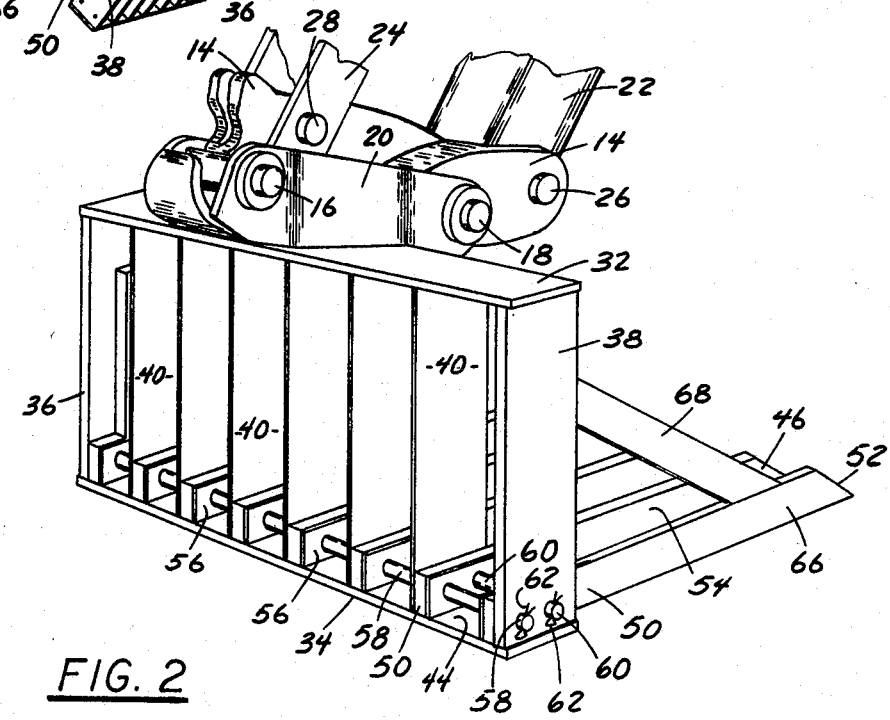
FIG. 2 is an enlarged fragmentary perspective of the same device with its teeth oriented, however, in a rearward direction.

The drawings illustrate a scoop-like lifting and moving device 10 in accordance with a preferred embodiment of this invention. Scoop-like device 10, as shown in FIGS. 1 and 2, is attached to a backhoe boom 12 by means of a quick coupler 14. More specifically, scoop-like device 10 includes a mounting member 20 which is secured to quick coupler 14 by pins 16 and 18. Quick coupler 14 is pivotably secured to boom members 22 and 24 by pins 26 and 28, respectively, and can be considered a part of a mounting member. Quick coupler 14 need not be used. Boom members 22 and 24 could be pivotably attached directly to mounting member 20 by means of pins 16 and 18, respectively.

More or less standard manipulations of the parts of backhoe boom 12 cause scoop-like device 10 to change its position and orientation. These movements are necessary for device 10 to slide under and pick up large pieces from the ground (for example, from a broken roadway), and deposit them elsewhere (for example, in a truck or in a pile).

Scoop-like device 10 includes a frame member 30 which extends downwardly from mounting member 20. Frame member 30 includes spaced parallel upper and lower members 32 and 34 which have generally flat horizontal major surfaces. Frame member 30 also includes end members 36 and 38 which, with upper member 32 and lower member 34, makes frame member 30 a box-like structure. End members 36 and 38 have parallel facing flat vertical surfaces.

Between end members 36 and 38 are a plurality of similar spaced vertical members 40, each parallel to the others, each having major flat surfaces parallel to the flat surfaces of vertical members 40, and each extending between upper member 32 and lower member 34. Voids 42, which are substantial in size, are formed between spaced vertical members 40. Most of the area encompassed by frame member 30 is taken by voids 42.

Figure 3:
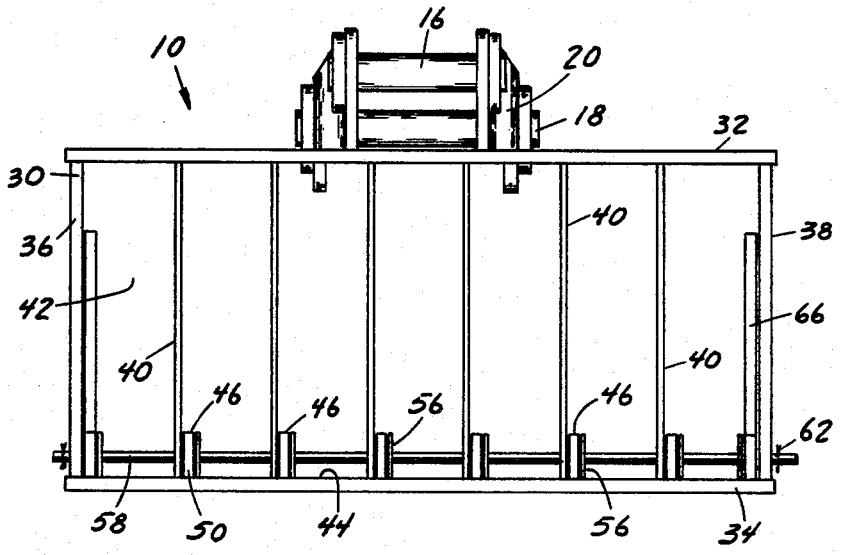
FIG. 3 is a fragmentary front elevation of FIG. 2.
Figure 4:
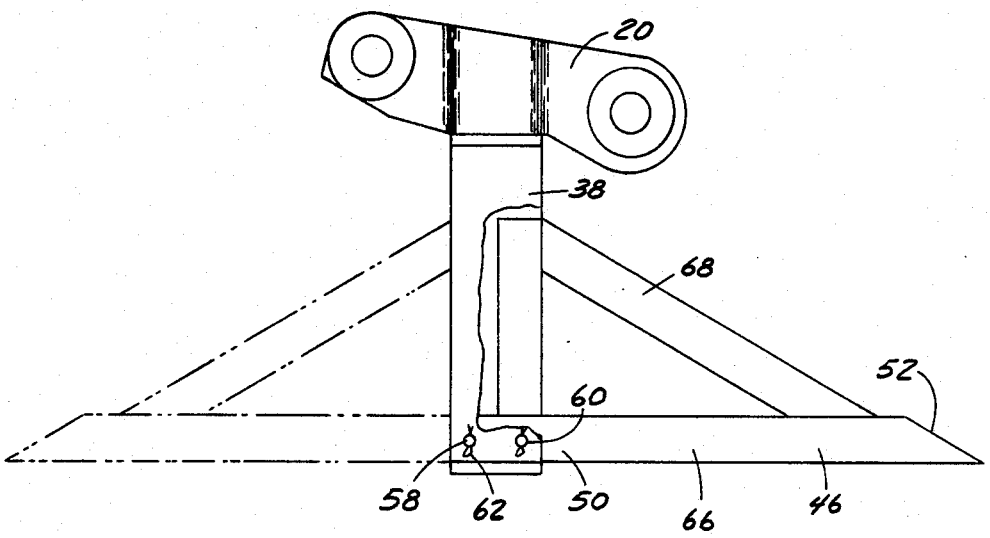
FIG. 4 is a right side elevation of FIG. 3, also including phantom lines illustrating the reverse mounting of teeth.

Lower member 34, which has a flat top surface 44, forms the lower edge of frame member 30. A plurality of elongated parallel teeth 46 extend laterally away from lower member 34 of frame member 30, either in a rearward direction (toward the vehicle) as shown in FIGS. 2, 3 and FIG. 4 or in a rearward direction (away from the vehicle) as shown in FIG. 1 and in phantom lines in FIG. 4. Teeth 46 together form a shelf 48 (see FIG. 1), generally perpendicular to frame member 30, which is used for lifting and moving large rocks, broken concrete, broken asphalt and the like. Shelf 48 has a proximal end 50 joined to the lower edge of frame member 30 and extends to a distal end 52.

Each tooth 46, like shelf 48, has a proximal end 50 and a distal end 52. Distal ends 52 are tapered to allow ready insertion of teeth 46 under large rocks and the like on the ground at the beginning of a lifting and moving operation. Teeth 46 are flat members which are mounted edgewise on flat top surface 44 of lower member 34. Such edgewise mounting provides better support for large rocks and the like during lifting and moving operations.

Substantial voids 54 are formed between adjacent teeth 46 and extend all across shelf 48, from immediately adjacent to frame member 30 all the way to distal ends 52. Voids 54 in shelf 48 and voids 42 in frame member 30 allow particulates to fall through scoop-like device 10, such that the large rocks, broken concrete pieces, broken asphalt pieces, or the like can be moved without also lifting and carrying smaller particulates.

Each tooth 46 has flat sides which, at a position near proximal edge 50, are each closely adjacent to and in contact with a spaced vertical member 40. In each case, the opposite flat surface of the tooth 46 has beside it a short vertical member 56 which is affixed to and extends upwardly from flat top surface 44 and forms a part of frame member 30. Each short vertical member 56 and its adjacent spaced vertical member 40 form a pair of vertical members receiving a tooth 46 therebetween. This structure helps hold teeth 46 in proper spaced alignment.

Teeth 46, short vertical members 56, spaced vertical members 40, and end members 36 and 38 each have a pair of holes through them. Such holes are in axial alignment with the corresponding holes of other members and receive rods 58 and 60. Rods 58 and 60 extend completely through frame member 30 and through each of the teeth 46. Rods 58 and 60 are held in place by cotter pin 62, as shown.) The rods and holes form means along the lower edge of frame member 30 for removable attachment of teeth 46.

The rods extend through the structure in a manner which allows easy removal and replacement. The holes are all spaced an equal distance above flat top surface 44 such that the mounting of teeth 46 may be in either a forwardly-extending direction or a rearwardly-extending direction.

In the preferred embodiment illustrated, teeth 46 are each separate and individually attached. They are not welded together in any manner. That is, any one of them can be removed and left out of the structure. Therefore, if one of them bends or becomes useless for any reason, it may readily be replaced. All of them are attached by means of rods 58 and 60 and the holes as described.

The separateness of teeth 46 facilitates reversal of the direction of shelf 48. Rather than removing and remounting a bulky and ungainly device, individual teeth can easily be transferred t the other side and slipped in the slots for attachment by rods 58 and 60, in the manner described.

While teeth 46 are preferably separate and individually attached, a cross member could be welded to them, preferably along their bottom edges in a position immediately adjacent to lower member 34 of frame member 30. This would not interfere with the operation of scoop-like device 10, but in certain situations it would make selective attachment of shelf 48 to frame member 30 more difficult.

Included among the teeth are a pair of end teeth 66. Each end tooth 66 includes a side member 68 which extends upwardly from the main portion of end tooth 66 in a position to prevent rocks and the like from falling off shelf 48. End teeth 66 are removed and remounted in the same manner as the other teeth 46.

Scoop-like device 10 of this invention is preferably made using sturdy steel members. Appropriate construction would be apparent to those skilled in the art who are made familiar with this invention.

While the principles of this invention have been described in connection with specific embodiments, it should be understood clearly that these descriptions are made only by way of example and are not intended to limit the scope of the invention.

What is claimed is:

1. In a device for lifting and moving large rocks and the like from the ground of the type including a vehicle, a boom with a proximal end secured to the vehicle and a distal end movable with respect to the vehicle, and a scoop member secured at the distal end, the improvement wherein the scoop member comprises:

a frame having a horizontal upper member and extending downwardly therefrom to a lower edge;

means secured to the horizontal upper member and pivotably connected to the boom, the connection means including a pair of spaced pivot attachment means forming separate pivot axes to allow both lifting and tilting of the frame by the boom;

means forming a shelf extending laterally from a proximal end along the frame lower edge to a distal end, the shelf means having a multiplicity of upwardly-facing support surfaces spaced thereacross and separated by substantial laterally-extending voids therebetween, thereby to support large rocks and the like without holding particulates; and means extending along and adjacent to the lower edge to removably attach the proximal end of the shelf means to the lower edge of the frame member selectively in either a forward position or a rearward position.

2. The device of claim 1 wherein the shelf means comprises a plurality of elongated parallel teeth spaced along the lower edge.

3. The device of claim 2 wherein the teeth are separate from one another, each individually attached to the lower edge.

4. The device of claim 2 wherein the parallel teeth are flat teeth mounted edgewise on the lower edge of the frame, thereby to better support large rocks and the like.

5. The device of claim 4 wherein:

each flat tooth has at least one hole therein along the proximal end; and the attachment means comprises at least one rod extending through the frame and through the hole in the flat teeth.

6. The device of claim 5 wherein:

each flat tooth has a pair of holes therein; and the attachment means comprises a pair of rods extending through the frame and through the pairs of holes in the flat teeth.

7. The device of claim 5 wherein the teeth are separate from one another, the attachment means supporting them in spaced parallel relationship.

8. The device of claim 2 wherein the plurality of teeth includes two end teeth, the end teeth each having a side member extending upwardly therefrom to prevent rocks and the like from falling from the shelf means.

9. The device of claim 1 wherein the frame includes a horizontal lower member spaced from the horizontal upper member and a plurality of spaced vertical members extending therebetween and defining substantial voids therebetween to support large rocks and the like without holding particulates.

10. The device of claim 1 wherein:

the frame includes a flat horizontal lower member along the lower edge, spaced from the horizontal upper member; and the shelf means comprises a plurality of elongated parallel teeth spaced along the flat horizontal lower member.

11. The device of claim 10 wherein the parallel teeth are flat teeth mounted edgewise on the lower member, thereby to better support large rocks and the like.

12. The device of claim 11 wherein the frame includes flat vertical members each affixed to the lower member and extending therefrom immediately adjacent to a flat tooth and being attached to said flat tooth.

13. The device of claim 12 wherein the frame includes pairs of said flat vertical members, each pair receiving therebetween a flat tooth.

14. The device of claim 13 wherein:

each flat tooth has at least one hole therein along the proximal end;

each flat vertical member attached to a tooth has at least one hole therein adjacent to one of the tooth holes; and the attachment means comprises at least one rod extending through the frame and through the holes in the flat teeth and flat vertical members.

15. The device of claim 14 wherein:

each flat tooth has a pair of holes therein;

each flat vertical member attached to a tooth has a matching pair of holes therein adjacent to the tooth holes; and the attachment means comprises a pair of rods extending through the frame and through the pairs of holes in the flat teeth and flat vertical members.

16. The device of claim 14 wherein the teeth are separate from one another, the attachment means supporting them in spaced parallel relationship.

17. The device of claim 16 wherein the plurality of teeth includes two end teeth, the end teeth each having a side member extending upwardly therefrom to prevent rocks and the like from falling from the shelf means.

18. A boom-supportable device for lifting and moving large rocks and the like from the ground comprising:

means for connection to a boom;

a frame secured to the connection means and extending downwardly therefrom to a lower edge, the frame having n upper member and, spaced therefrom, a flat horizontal lower member along the lower edge;

a plurality of elongated parallel flat teeth spaced along the flat horizontal lower member edgewise thereon and extending laterally from proximal ends along the lower edge to distal ends to form a shelf, the teeth having substantial voids therebetween to support large rocks and the like without holding particulates and each tooth having at least one tooth hole therein along its proximal end;

pairs of flat vertical members each affixed to the lower member and extending therefrom immediately adjacent to a flat tooth, each of the vertical members having at least one hole therein adjacent to one of the tooth holes and each such pair of vertical members receiving one of said teeth therebetween;

at least one rod extending through the frame and through the holes in the teeth and vertical members to removably attach the teeth to the lower edge of the frame selectively in either a forward position or a rearward position; and one of the vertical members of each pair extending between the lower and upper frame members, such vertical members defining substantial voids therebetween to support large rocks and the like without holding particulates.

19. The device of claim 18 wherein a pair of said holes are in each tooth and each vertical member and two rods extend through the frame, the vertical members and the teeth.

* * * * *

UNITED STATES PATENT AND TRADEMARK OFFICE

CERTIFICATE OF CORRECTION

PATENT NO. : 4,790,717

DATED : December 13, 1988

INVENTOR(S) : Ronald L. Anderson

It is certified that error appears in the above-identified patent and that said Letters Patent is hereby corrected as shown below:

On the cover sheet, the name of the Attorney, Agent or Firm should read --Peter N. Jansson, Ltd.--

In column 6, line 6, change "t the" to --to the--.

In claim 18, line 7, change "having n" to --having an--.

Signed and Sealed this

Twenty-third Day of May, 1989

*Attest:*

*Attesting Officer*

DONALD J. QUIGG

*Commissioner of Patents and Trademarks*